US006095499A

United States Patent [19]

Johnson

[11] Patent Number: 6,095,499

[45] Date of Patent: Aug. 1, 2000

[54] HAND OPERABLE MOTORCYCLE STAND

[76] Inventor: Robert C. Johnson, 7741 - 237th Ave. NE., Stacy, Minn. 55079

[21] Appl. No.: 09/025,484

[22] Filed: Feb. 18, 1998

Related U.S. Application Data

[63] Continuation-in-part of application No. 08/992,237, Dec. 17, 1997, Pat. No. 5,927,689, and a continuation-in-part of application No. 09/018,029, Feb. 3, 1998

[60] Provisional application No. 60/060,566, Sep. 30, 1997.

[51] Int. Cl.[7] ..... B66F 7/22

[52] U.S. Cl. ..... 254/131

[58] Field of Search ..... 254/10 R, 10 B, 254/10 C, 131, 120, 134, 133, 90, 91

[56] References Cited

U.S. PATENT DOCUMENTS

| | | | |
|---|---|---|---|
| 1,171,049 | 2/1916 | Jeffery . | |
| 1,307,600 | 6/1919 | Rose et al. . | |
| 1,354,529 | 10/1920 | Alexander . | |
| 1,492,461 | 4/1924 | Howe . | |
| 3,059,904 | 10/1962 | Kimball | 254/10 C |
| 4,113,235 | 9/1978 | Hartman, Jr. . | |
| 4,180,253 | 12/1979 | Ivers et al. . | |
| 4,193,582 | 3/1980 | Neilsen . | |
| 4,324,384 | 4/1982 | Elser . | |
| 4,348,010 | 9/1982 | Baxter . | |
| 4,804,068 | 2/1989 | Carter | 254/91 |
| 5,639,067 | 6/1997 | Johnson . | |

*Primary Examiner*—Robert C. Watson
*Attorney, Agent, or Firm*—Michael S. Sherrill

[57] ABSTRACT

A compact, hand-operable stand for quickly and easily elevating a motorcycle, including (i) a base assembly, and (ii) a support assembly pivotably attached to the base assembly for pivoting about a longitudinal axis between a clearance position and a support position, and including a pair of transversely spaced support arms and a means for effecting simultaneous pivoting of both support arms between the clearance and support positions.

13 Claims, 14 Drawing Sheets

HAND OPERABLE MOTORCYCLE STAND

This is a continuation-in-part of U.S. patent application Ser. No. 08/992,237, filed Dec. 17, 1997, now U.S. Pat. No. 5,927,689 and a continuation-in-part of U.S. patent application Ser. No. 09/018,029, filed Feb. 3, 1998, which claims the benefit of U.S. provisional application Ser. No. 60/060,566, filed Sep. 30, 1997.

FIELD OF THE INVENTION

The present invention relates generally to jacks, and more particularly to portable jacks or supports for elevating at least one of the two ends of a motorized two-wheel vehicle such as a motorcycle.

BACKGROUND

The need has existed ever since motorized two-wheel vehicles were first developed for a convenient way to service the wheel and related components at one end of the vehicle. Although ramps or lifts may be helpful, they generally take up a large amount of space. Furthermore, the motorcycle may require emergency servicing at a location remote from the bulky ramps and lifts, as when a mechanical failure occurs while the motorcycle is on the road.

Attempts have also been made to rely on the motorcycle kickstand to support the cycle while servicing it. However, the kickstand, although attached directly to the frame of the cycle itself and therefore extremely portable, has a relatively pointed end that may dig into sand, grass or blacktop resulting in unstable support for the motorcycle. Additionally, using the kickstand will not lift the front or rear wheel of the cycle off the ground.

Devices are also known for elevating automobiles by engaging an axle of the vehicle. However, motorcycles lack a suitably exposed axle, and the adaptation of such devices to motorcycles have resulted in the risk of scratching or damaging the surface of the motorcycle frame with the lift.

A compact motorcycle stand is disclosed in U.S. Pat. No. 5,639,067 issued to Robert C. Johnson. The motorcycle stand includes a support roller (12) pivotably mounted to a base assembly (18) by means of an axle (56 and 58), with the axle fixedly attached to the support roller by a pair of brackets (14 and 16) and rotatably extending through a pair of bearings (50 and 52) secured to the base assembly. One end of the axle extends a distance beyond the base assembly for permitting rotation of the axle between a clearance position (forward of the base assembly) and a support position (above the base assembly) with a wrench (86) and appropriately sized socket (88).

While the motorcycle stand disclosed in U.S. Pat. No. 5,639,067 represents a significant advance, a continuing demand exists for still further improved motorcycle stands.

SUMMARY OF THE INVENTION

The invention is a compact, hand-operable stand for quickly and easily elevating a motorcycle. The basic stand includes (i) a base, and (ii) a support assembly pivotably attached to the base for pivoting about a longitudinal axis between a clearance position and a support position, and (iii) a means for preventing continued pivoting of the support assembly beyond the support position. The support assembly includes a pair of transversely spaced support arms, and a means for effecting simultaneous pivoting of both support arms between the clearance position and the support position.

When pivoted into the clearance position, the support assembly is pivoted downward into the plane defined by the base for permitting the stand to be slid underneath the frame of a motorcycle. When pivoted into the support position, the support assembly is pivoted upward from the plane defined by the base for permitting the support assembly to contact the frame of a motorcycle and elevate the motorcycle above grade.

The stand can further include a mounting assembly pivotably attached to the base and holding the support assembly in a transversely spaced relationship relative to the base, with the support assembly and mounting assembly pivotable together between the clearance position and the support position.

The stand can include one or more additional features selected from, (a) providing a means for repositionably attaching the support assembly to the mounting assembly at a plurality of different distances between the support assembly and the base assembly and thereby changing the height to which the stand is capable of elevating a motorcycle, and (b) providing a flange extending from a first longitudinal end of the base assembly effective for being engaged by a user's foot so as to stabilize the stand during pivoting of the support assembly between the clearance and support positions, and (c) configuring and arranging the mounting assembly and support assembly to provide at least two transversely elongated, longitudinally spaced engagement elements with relatively thin longitudinal profiles capable of independent longitudinal repositioning for alignment of each engagement element with a structural element of a motorcycle frame so as to accommodate motorcycles with a recessed frame (e.g., the engine extends lower than the frame).

DETAILED DESCRIPTION OF THE INVENTION INCLUDING A BEST MODE

Nomenclature

F Frame of Motorcycle

M Motorcycle

100 Stand

110 Base Assembly

111 Central Beam

111*c* Top Flange of Beam

111*d* Bottom Flange of Beam

112 First Leg

113 Foot Flange

114 Second Leg

115 Main Bearings

119 Openings Through Legs of Base

120 Support Assembly

121 Axle of Support Assembly

121*a* First End of Axle

121*b* Second End of Axle

121*g* Circumferential Grooves in Axle

122 Support Tube

123 Outer Layer of Material

125 Bearings for Axle of Support Assembly

126 Connect Arms

127 Holes Through Ends of Connect Arms

130 Mounting Assembly

131 Pivot Shaft

131*a* First End of Pivot Shaft

131*b* Second End of Pivot Shaft

131*g* Circumferential Grooves in Pivot Shaft

132 Brackets

132*a* Proximal End of Bracket

132*b* Distal End of Bracket

133 Finger

134 Holes Through Bracket for Axle of Support Assembly

135 Hole Through Bracket for Pivot Shaft

136 Outer Layer of Material

200 Tool

201 Handle

202 Socket

203 Dowel

220 Engagement Element

220*a* First Transverse End of Engagement Element

220*b* Second Transverse End of Engagement Element

221 Connecting Pin

222 Y-Shaped Elements

223 Legs of Y-Shaped Element

224 Arms of Y-Shaped Element

225 Lower Channel Defined by Legs of Y-Shaped Element

226 Upper Channel Defined by Arms of Y-Shaped Element

227 Holes Through Legs of Y-Shaped Element

240 Shaft Collar

Construction

Figure 1:
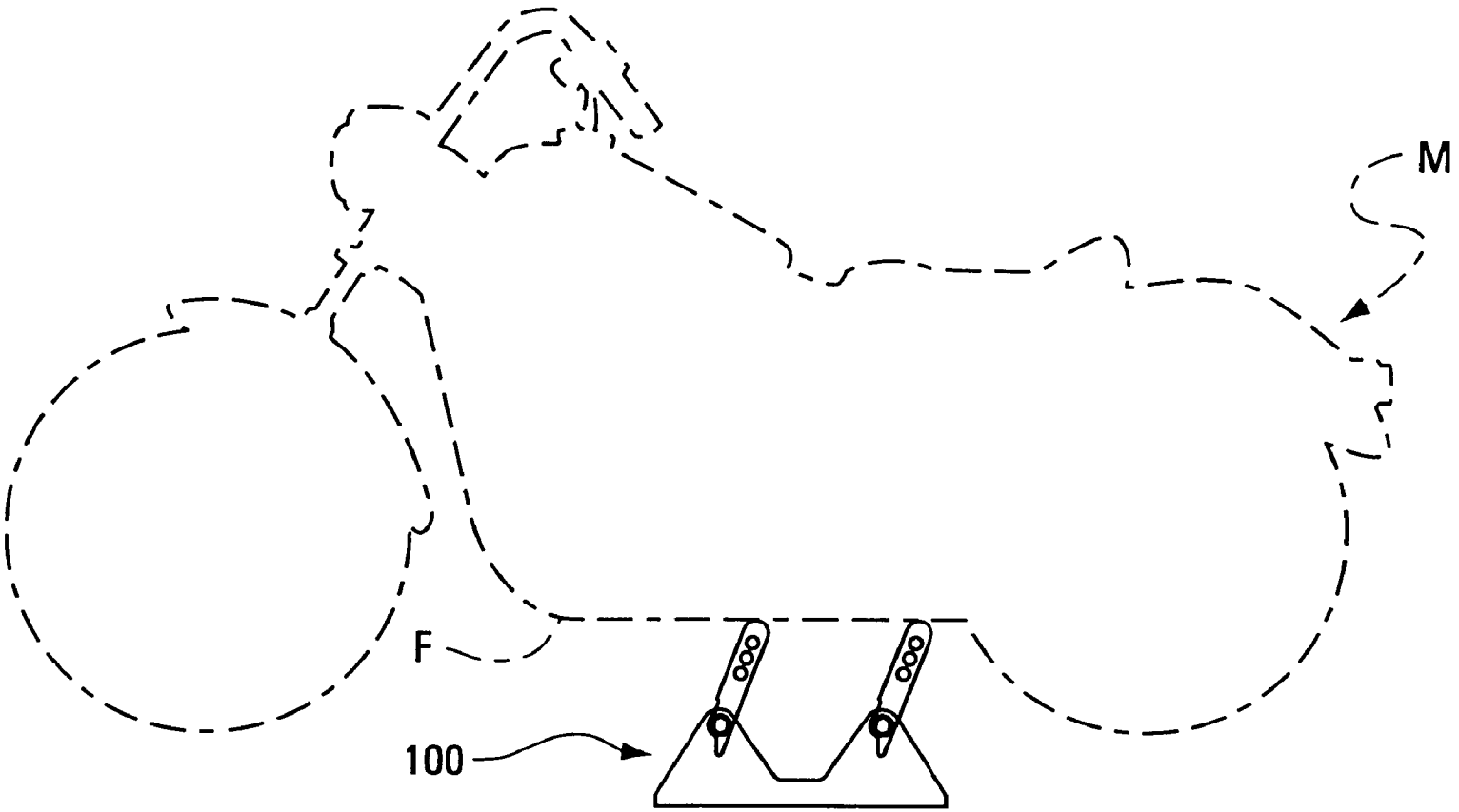
FIG. 1 is a side view of a first embodiment of the stand positioned beneath and supporting a motorcycle.
Figure 2:
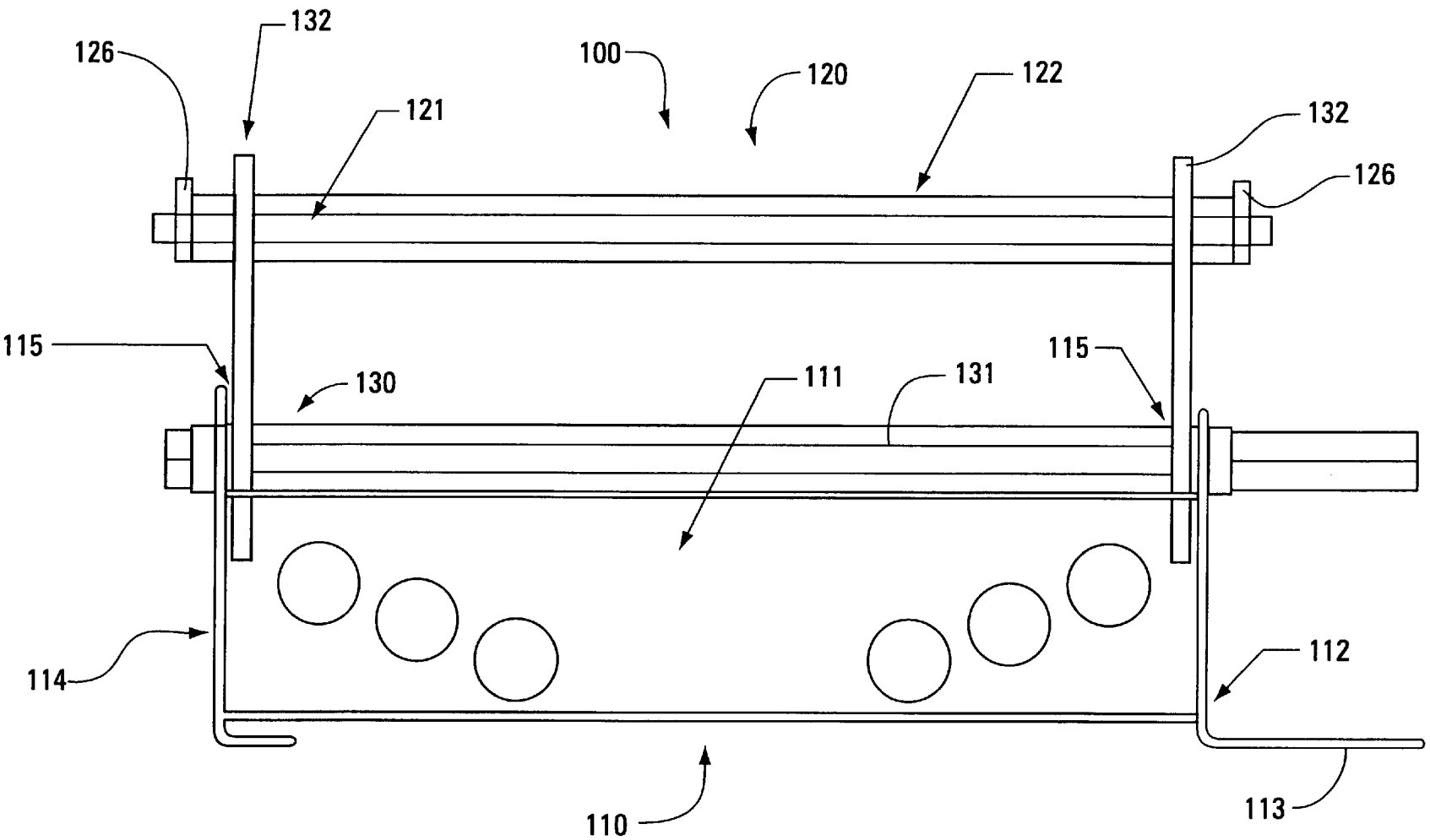
FIG. 2 is a front view of the first embodiment of the stand shown in FIG. 1 in the support position.
Figure 3:
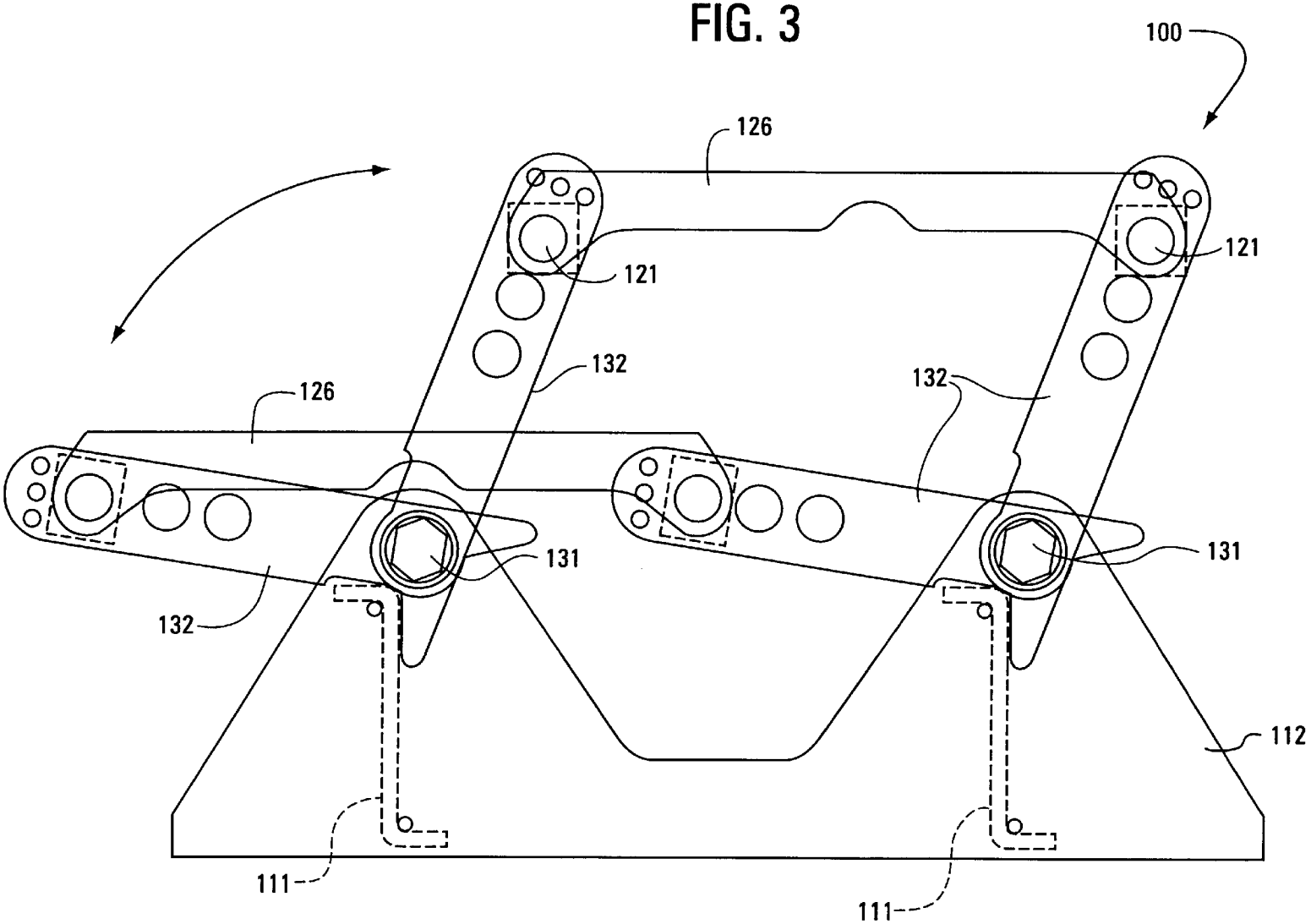
FIG. 3 is a side view of the stand shown in FIG. 2, showing pivoting of the mounting assembly and support assembly between the clearance position and the support position.

With reference to the drawings, and in particular to FIGS. 2 and 3, the motorcycle stand is generally indicated by reference number 100. A first embodiment of the motorcycle stand 100 includes a pair of support assemblies 120 rotatably mounted to a corresponding mounting assembly 130, which in turn are pivotably mounted to a base assembly 110. A second embodiment of the motorcycle stand 100, depicted in FIGS. 17 and 18, includes independent engagement elements 220 pivotably mounted to brackets 132, which in turn are each separately pivotably mounted to different transversely spaced pivot shafts 131. As seen in FIG. 1, the first embodiment of the stand 100 is effective for supporting the frame F of a motorcycle M upon the support assemblies 120 in an elevated position. Similarly, as seen best in FIG. 17, the second embodiment of the stand 100 is effective for engaging multiple transversely spaced points along two longitudinally spaced elements of a motorcycle frame F within the engagement elements 220 and thereby supporting the motorcycle M in an elevated position.

The stand 100 may be positioned to elevate one end of the motorcycle, or positioned centrally under the frame F to elevate both ends of the motorcycle as shown in FIG. 1. Essentially identical elements with essentially similar function are denoted with identical reference numerals.

BASE ASSEMBLY

FIGS. 2 and 3 show an embodiment of the base assembly 110 comprising first 112 and second 114 saw tooth legs connected by a pair of central beams 111.

Main bearings 115 are positioned within orifices (unnumbered) proximate both apexes (unnumbered) of each saw tooth leg 112 and 114 for rotatably supporting a pair of pivot shafts 131.

An optional foot flange 113 longitudinally extends from the bottom edge (unnumbered) of the first leg 112 a distance sufficient to permit the foot flange 113 to be engaged by a user's foot (not shown) for stabilizing the stand 100 during pivoting of the support assemblies 120 between a clearance position and a support position. Generally, a foot flange 113 having a longitudinal length of about 2 to 10 cm is effective for achieving the desired stabilization effect, with a length of about 6 to 10 cm generally preferred.

Figure 10:
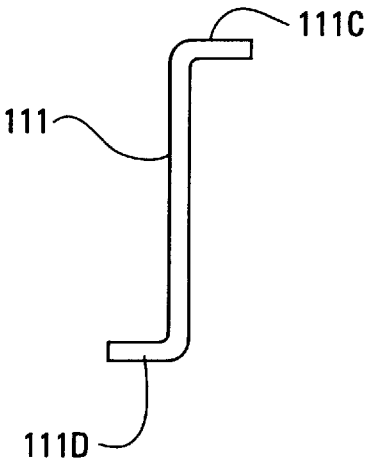
FIG. 10 is an enlarged side view of the central beam shown in FIG. 9.
Figure 12:
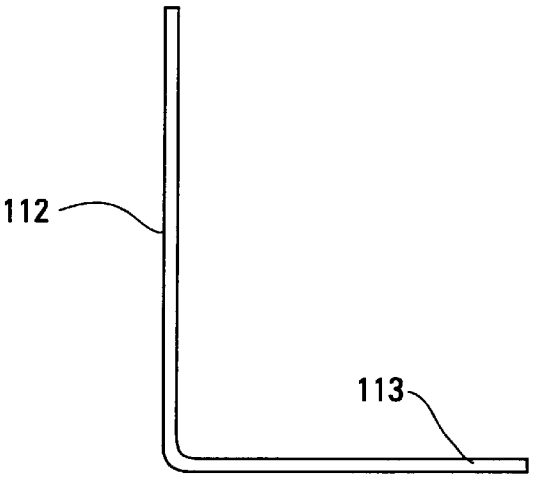
FIG. 12 is an enlarged side view of the first leg shown in FIG. 11.
Figure 11:
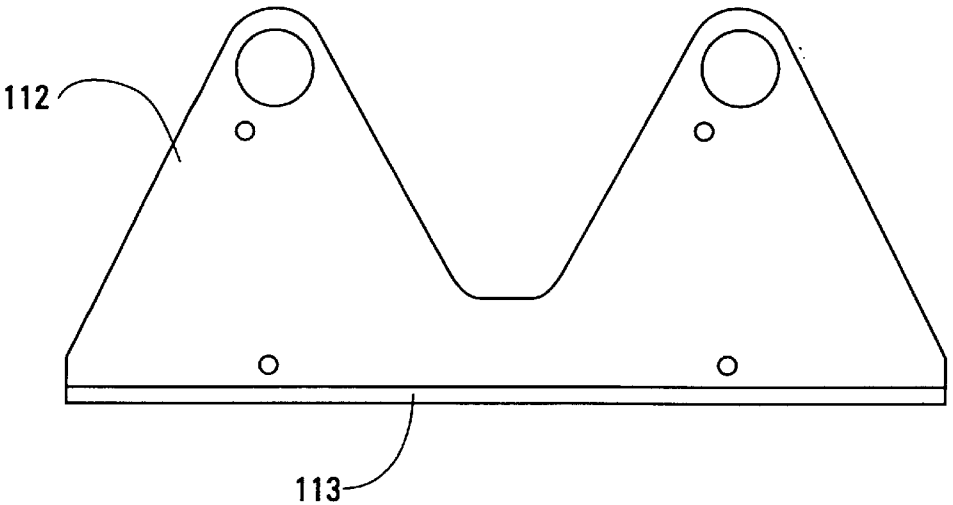
FIG. 11 is an enlarged front view of the first leg shown in FIG. 2.
Figure 14:
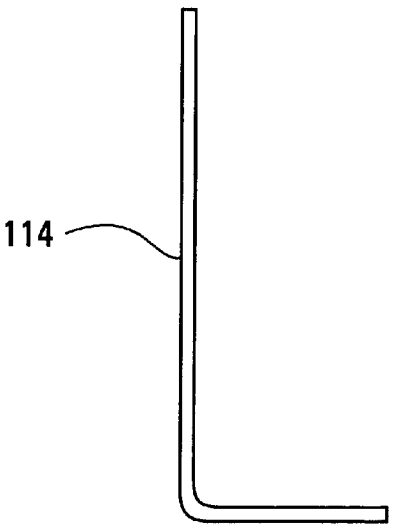
FIG. 14 is an enlarged side view of the second leg shown in FIG. 13.
Figure 13:
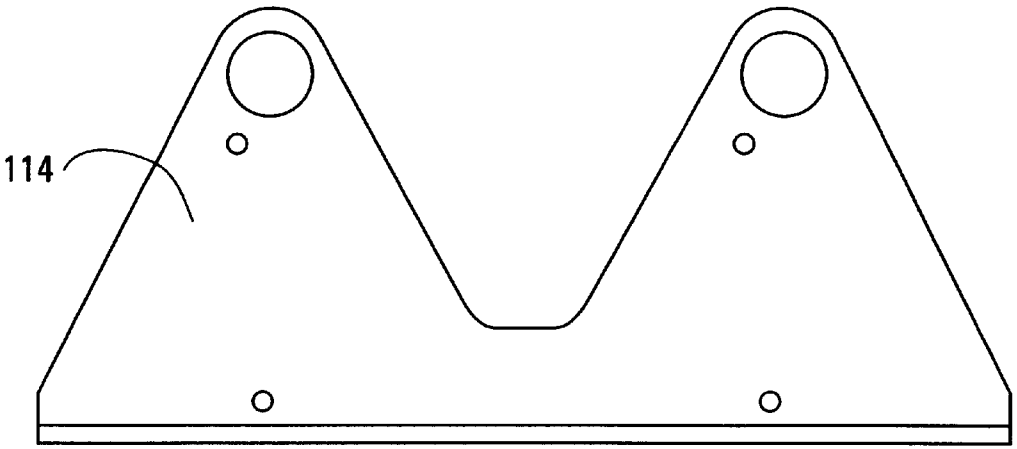
FIG. 13 is an enlarged front view of the second leg shown in FIGS. 2 and 3.

As shown best in FIGS. 3 and 10, the central beams 111 are preferably Z beams, each having a forward extending top flange 111*c* and a rearward extending bottom flange 111*d* for purposes of providing superior lateral support (i.e., structural support from front to back), and providing a surface 111*c* for stopping continued motion of the brackets 132 at the clearance position as well as supporting the brackets 132 in the clearance position.

The beams 111 and legs 112 and 114 may be constructed from a single unitary piece of material or the beams 111 may be connected to the legs 112 and 114 by any convenient means such as welding.

MOUNTING ASSEMBLY

FIGS. 2 and 3 show an embodiment of the mounting assemblies 130, with each mounting assembly 130 comprising (i) a pivot shaft 131 rotatably supported within a main bearing 115 in each of the legs 112 and 114 of the base assembly 110, and (ii) a pair of brackets 132 with one bracket of each pair proximate each longitudinal end 131*a* and 131*b* of a pivot shaft 131. The brackets 132 are fixedly attached to the corresponding pivot shaft 131 so that rotational motion of the pivot shaft 131 is translated into a pivoting motion of the corresponding brackets 132.

Pivot Shaft

Figure 5:
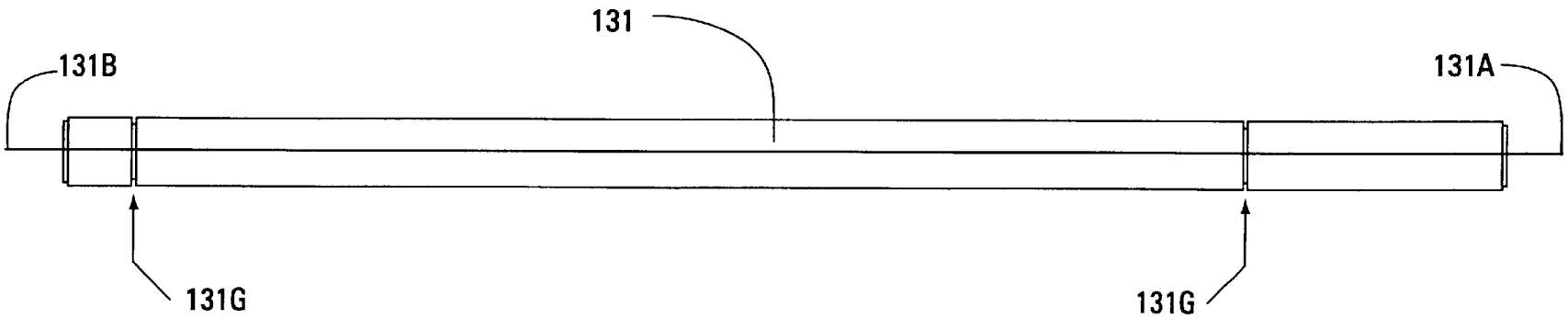
FIG. 5 is an enlarged front view of the pivot shaft shown in FIGS. 2 and 3.

As shown in FIG. 5, the pivot shafts 131 can be provided with circumferential grooves 131*g* proximate both longitudinal ends 131*a* and 131*b* for accommodating a retaining ring (not shown) so as to prevent the pivoting shafts 131 from longitudinally sliding within the main bearings 115. Other similar retention means can be also be employed, such as a cotter pin (not shown) inserted through a radically extending hole (not shown) in each end 131*a* and 131*b* of each pivot shaft 131.

The first end 131*a* of one of the pivot shafts 131 extends a substantial distance beyond the vertical portion (unnumbered) of the first leg 112 to facilitate attachment of a socket 202 to the extended distal end 131*a* of the pivot shaft 131 for rotating the pivot shaft 131 between the clearance and support positions. The first end 131*a* of the extended pivot shaft 131, and optionally the entire length of the extended pivot shaft 131, preferably has a cross-section with comers (e.g., triangular, square, pentagonal, hexagonal, etc.) which can be engaged by a matching socket 202. If desired, the extended pivot shaft 131 can be configured and arranged so that both ends 131*a* and 131*b* of the extended pivot shaft 131 project a sufficient distance beyond the corresponding leg 112 and 114 that the extended pivot shaft 131 can be accessed and rotated from either end of the stand 100. The non-extended pivot shaft 131 optionally has a cross-section with corners (e.g., triangular, square, pentagonal, hexagonal, etc.) as well.

Brackets

Figure 4:
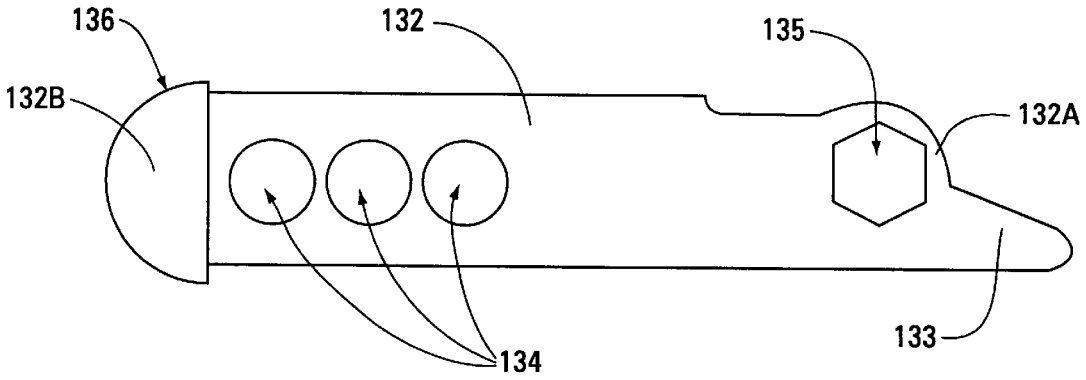
FIG. 4 is an enlarged side view of one of the brackets shown in FIGS. 2 and 3.

As shown best in FIG. 4, each of the four brackets 132 includes (i) a hole 135 proximate the proximal end 132*a* of the bracket 132 for permitting passage of a pivot shaft 131 through the bracket 132, (ii) a plurality of transversely spaced holes 134 proximate the distal end 132*b* of each bracket 132 for accommodating a support assembly bearing 125 and permitting passage of a support assembly axle 121 through the bearing 125, and (iii) an offset finger 133 extending from the proximal end 132*a* of the bracket 132 for contacting a central beam 111 so as to stop continued motion of the bracket 132 at the support position and support the brackets 132 and support assemblies 120 in the support position, including any motorcycle M resting upon the support assemblies 120.

When the pivot shafts 131 have a cross-sectional configuration with corners (e.g., triangle, square, pentagon, hexagon, etc.), holes 135 through the corresponding pair of brackets 132 are preferably shaped to match the cross-sectional shape of the pivot shaft 131 so that rotation of the pivot shaft 131 results in a pivoting of the pair of brackets 132 about the longitudinal axis (not shown) of the pivot shaft 131.

As shown best in FIG. 3, the brackets 132 are pivoted slightly past the center of gravity when in the support position. This tends to lock the brackets 132 and corresponding support assemblies 120 into position and prevent accidental pivoting of the brackets 132 and support assemblies 120 from the support position to the clearance position, particularly when the additional weight of a motorcycle M is bearing down upon the support assemblies 120. Generally, an angle of about 2° to 10° past the center of gravity is effective for locking the brackets 132 and support assemblies 120 into the support position.

As may be seen best in FIGS. 1, 2 and 3, the distal ends 132*b* of the brackets 132 extend beyond the support assembly 120 and serve as stops to ensure that the frame F of a motorcycle M remains centered on the support tubes 122. The distal ends 132*b* of the brackets 132 can be coated with an outer layer 136 of a soft material, such as a natural or synthetic rubber or polyurethane compound, to prevent the distal ends 132*b* of the brackets 132 from scratching the frame F of a motorcycle M mounted upon the stand 100.

SUPPORT ASSEMBLY

In a first embodiment of the stand 100, a support assembly 120 is rotatably retained in a transversely spaced relationship relative to the base assembly 110 by each pair of brackets 132.

Figure 6:
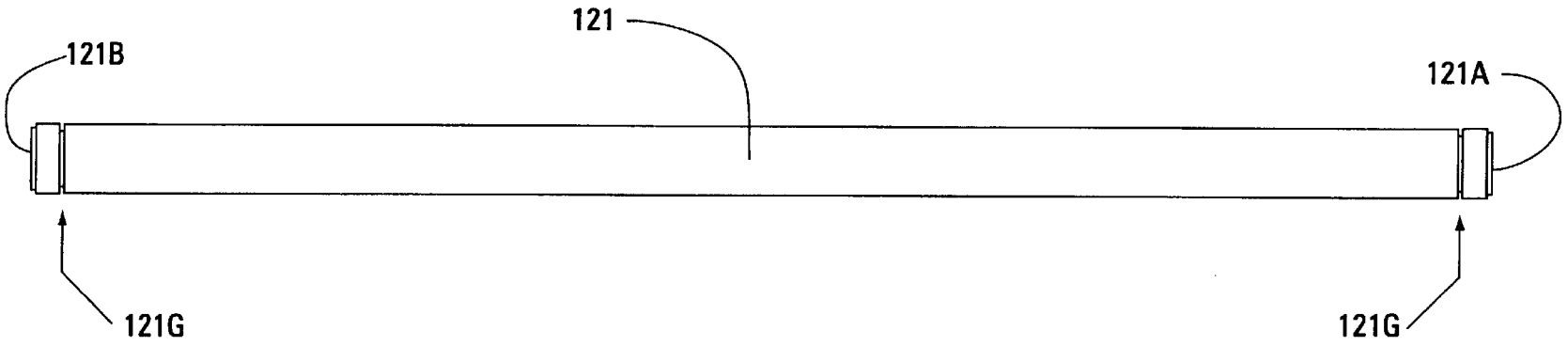
FIG. 6 is an enlarged front view of the support assembly axle shown in FIGS. 2 and 3.
Figure 7:
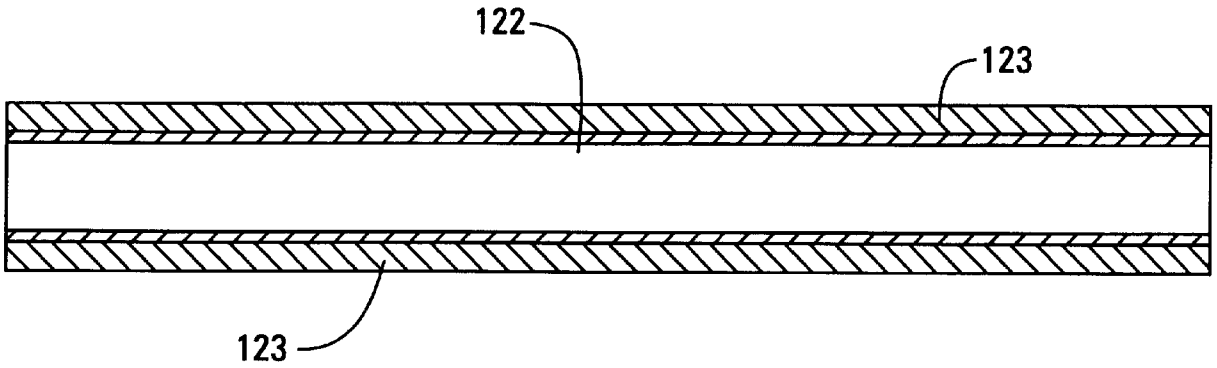
FIG. 7 is an enlarged front view of the support tube shown in FIGS. 2 and 3.
Figure 8:
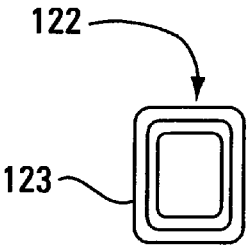
FIG. 8 is an enlarged side view of the support tube shown in FIG. 7.
Figure 9:
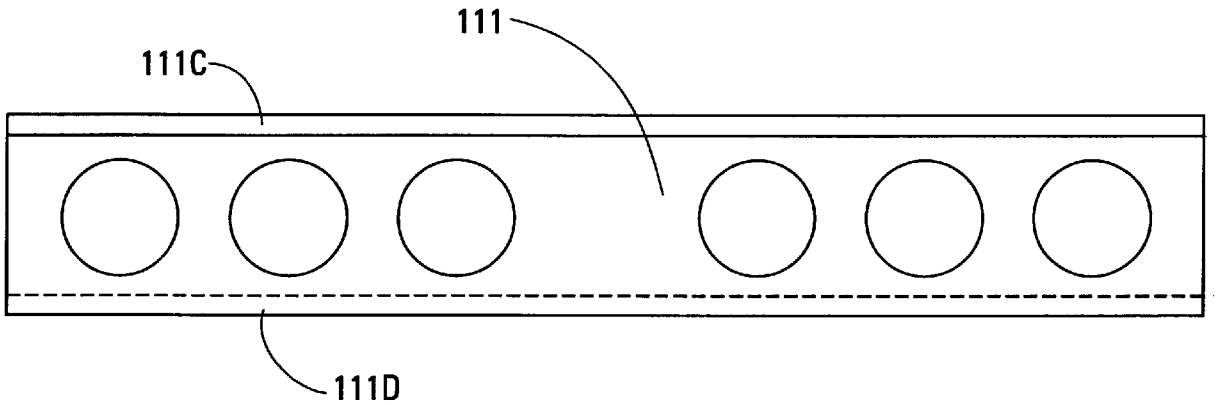
FIG. 9 is an enlarged front view of the central beam shown in FIGS. 2 and 3.

FIGS. 6 and 7 show an embodiment of the support assembly 120 comprising an axle 121 and a support tube 122, with the channel (unnumbered) through the support tube 122 sized to accommodate passage of the axle 121 with limited tolerance.

The support tube 122 can be coated with an outer layer 123 of a soft material, such as a natural or synthetic rubber or polyurethane compound, to prevent the support tube 122 from scratching the frame F of the motorcycle M.

Support assembly bearings 125 are provided at both ends 121*a* and 121*b* of each axle 121 for rotatably supporting each axle 121 within a longitudinally aligned pair of holes 134 through a pair of brackets 132.

As shown in FIG. 6, the axle 121 of each support assembly 120 can be provided with circumferential grooves 121*g* proximate both longitudinal ends 121*a* and 121*b* for accommodating a retaining ring (not shown) and thereby preventing the axle 121 from longitudinally sliding within the bearings 125. Other similar retention means can also be employed, such as a cotter pin (not shown) inserted through a radically extending hole (not shown) in each end 121*a* and 121*b* of the axle 121.

Figure 16:
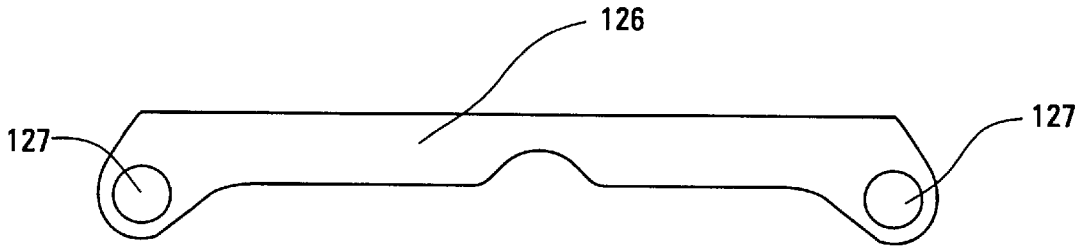
FIG. 16 is an enlarged side view of one of the connect arms shown in FIGS. 2 and 3.

As shown in FIGS. 2 and 3, a pair of connect arms 126 extend perpendicularly between the pair of support assembly axles 121 with a first connect arm 126 connecting the first longitudinal ends 121*a* of the axles 121 and a second arm 126 connecting the second longitudinal ends 121*b* of the axles 121. As shown in FIG. 16, the connect arms 126 have a hole 127 through each end (unnumbered) for permitting passage of an end 121*a* or 121*b* of a support axle 121 therethrough. The connect arms 126 are preferably connected to the axles 121 between the bracket 132 and the circumferential groove 121*g* at each longitudinal end 121*a* and 121*b* of each axle 121 The connect arms 126 are prevented from sliding off the axles 121 by retaining rings (not shown), or similar retaining means such as a cotter pin (not shown) inserted through a radially extending hole (not shown) in each end 121*a* and 121*b* of the axles 121.

The connect arms 126 interconnect both support assembly axles 121 and cause both support axles 121 and accompanying support tubes 122 to move together in unison as a single unit. Hence, rotation of the extended pivot shaft 131 effects simultaneous pivoting of both support assemblies 120 between the clearance and support positions.

ENGAGEMENT ELEMENTS

In a second embodiment of the stand 100, a transversely elongated engagement element 220 is pivotably attached to the distal ends 132*d* of each transverse set of brackets 132 (i.e., connected to two brackets 132 with the brackets 132 connected to different pivot shafts 131).

Figure 17:
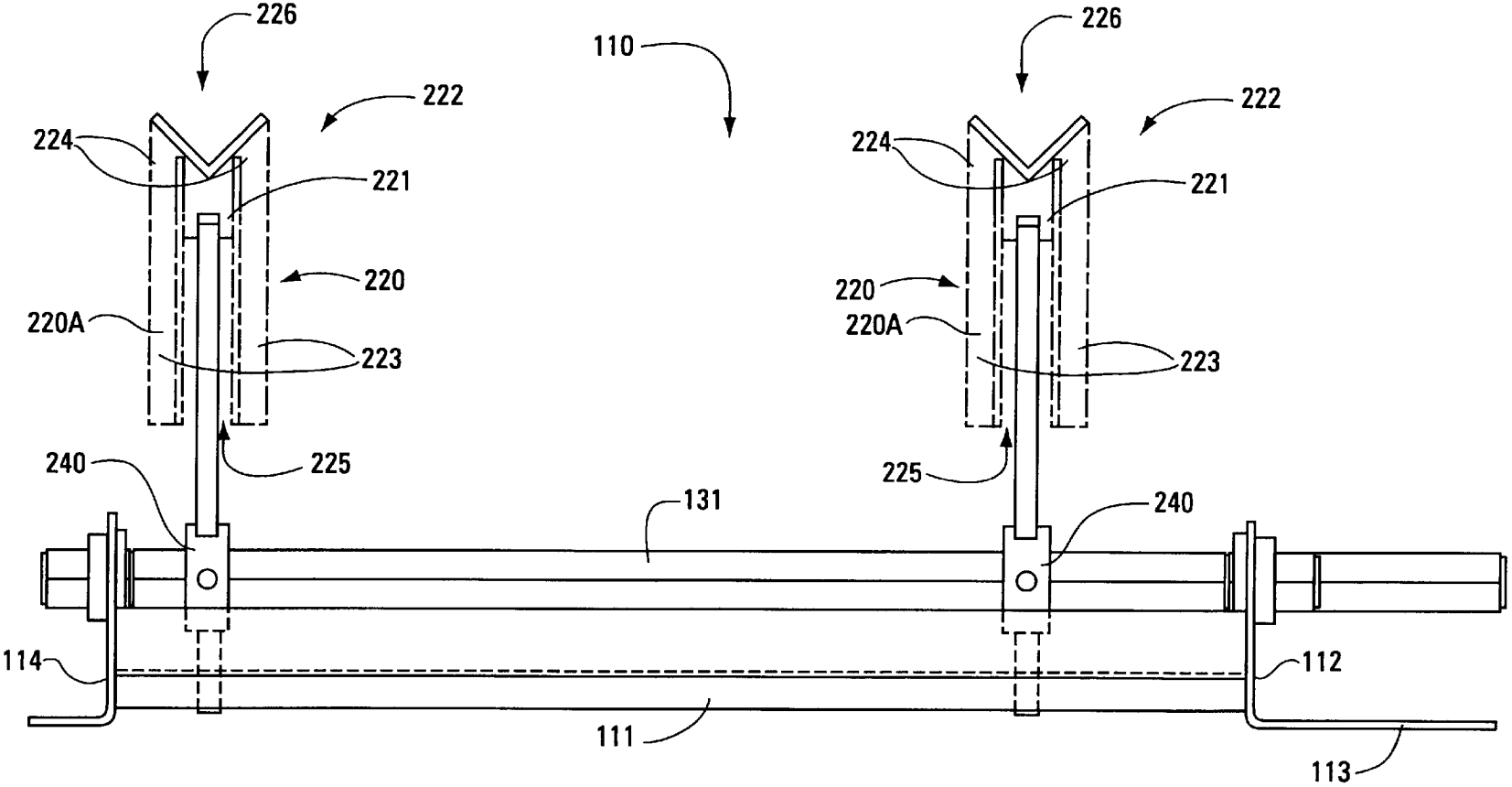
FIG. 17 is a front view of a second embodiment of the stand shown in the support position.
Figure 18:
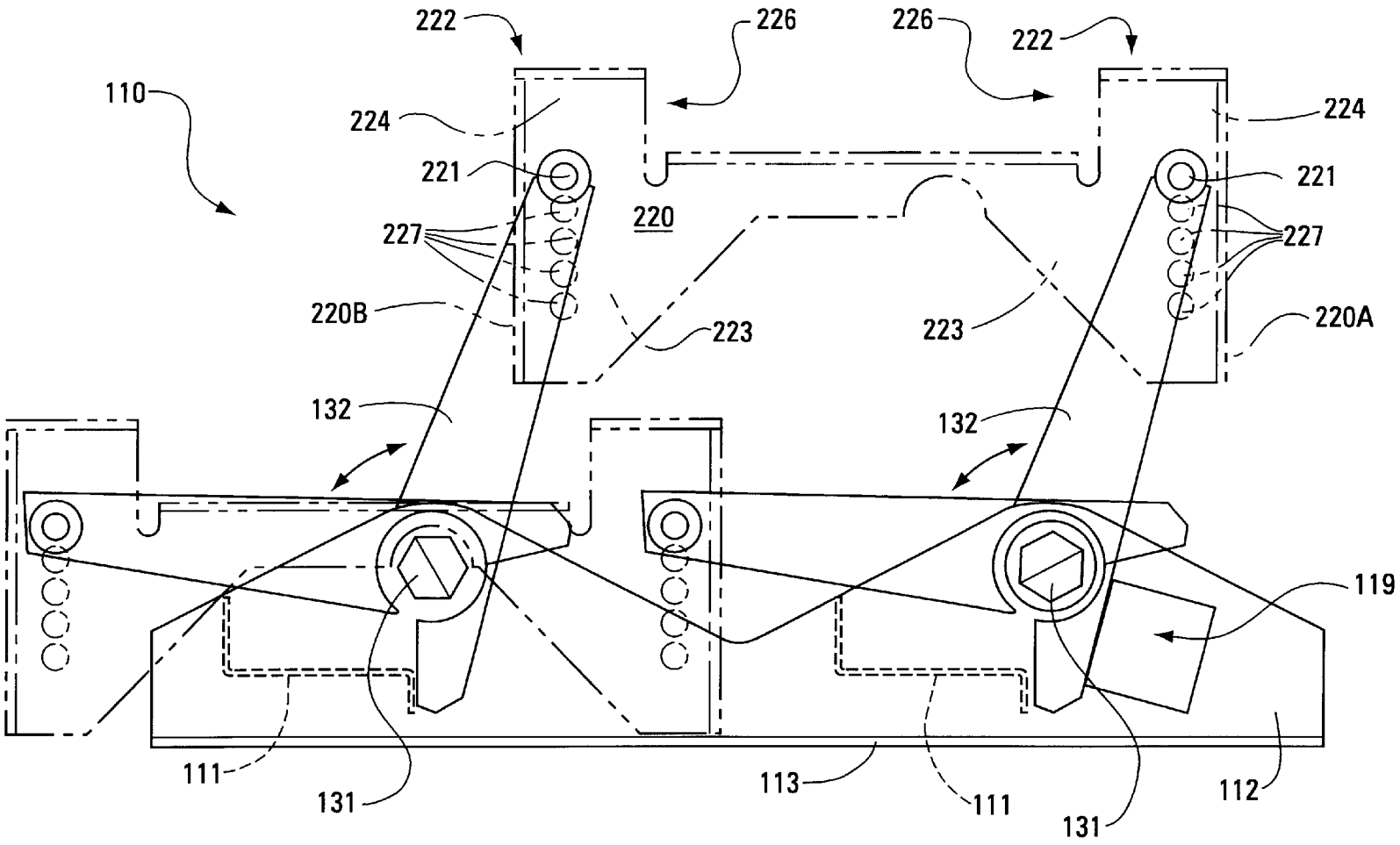
FIG. 18 is a side view of the stand shown in FIG. 16, showing pivoting of the mounting assembly and support assembly between the clearance position and the support position.

FIGS. 17 and 18 show an embodiment of an engagement element 220 comprising a transversely elongated element 220 having transversely spaced Y-shaped elements 222 at each transverse end 220*a* and 220*b* of the element 220. Each Y-shaped element 222 has a pair of legs 223 defining an open-faced lower channel 225, and a pair of arms 224 defining an open-faced upper channel 226. The open-faced lower channels 225 are sized to accommodate positioning of the distal end 132*d* of a bracket 132 within each of the lower channels 225. The open-faced upper channels 226 are sized to engage and retain a segment of a motorcycle frame F.

Each engagement element 222 is pivotably connected proximate each transverse end 220*a* and 220*b* to the distal end 132*d* of a bracket 132 by a connecting pin 221 extending through longitudinally aligned orifices (unnumbered) in the legs 223 of the Y-shaped element 222 and the distal end 132*d* of the corresponding bracket 132. Accordingly, each engagement element 222 is pivotably connected via bracket 132 to both pivot shafts 131.

Alternatively, the engagement means 220 can be provided with a single, transversely elongated Y-shaped element 222 extending substantially the entire length of the engagement means 200 rather than multiple Y-shaped elements 222 as shown in FIGS. 17 and 18.

The Y-shaped elements 222 can be coated with an outer layer (not shown) of a soft material, such as a natural or synthetic rubber or polyurethane compound, to prevent the engagement elements 220 from scratching the frame F of the motorcycle M.

As shown in FIG. 17, the brackets 132 can be provided with a shaft collar 240, circumscribing hole 135 in the bracket 132 for permitting independent longitudinal repositioning of the engagement means 220 along the pivot shaft 131. The ability to independently longitudinally reposition the engagement means 220 permits the engagement means 220 to be repositioned as necessary to accommodate different motorcycle models having differently sized and configured frames F.

TOOL

A tool 200 can be provided to facilitate rotation of the extended pivot shaft 131 and thereby effect pivoting of both and support assemblies 120 the accompanying brackets 132 between the clearance and support positions.

Figure 15:
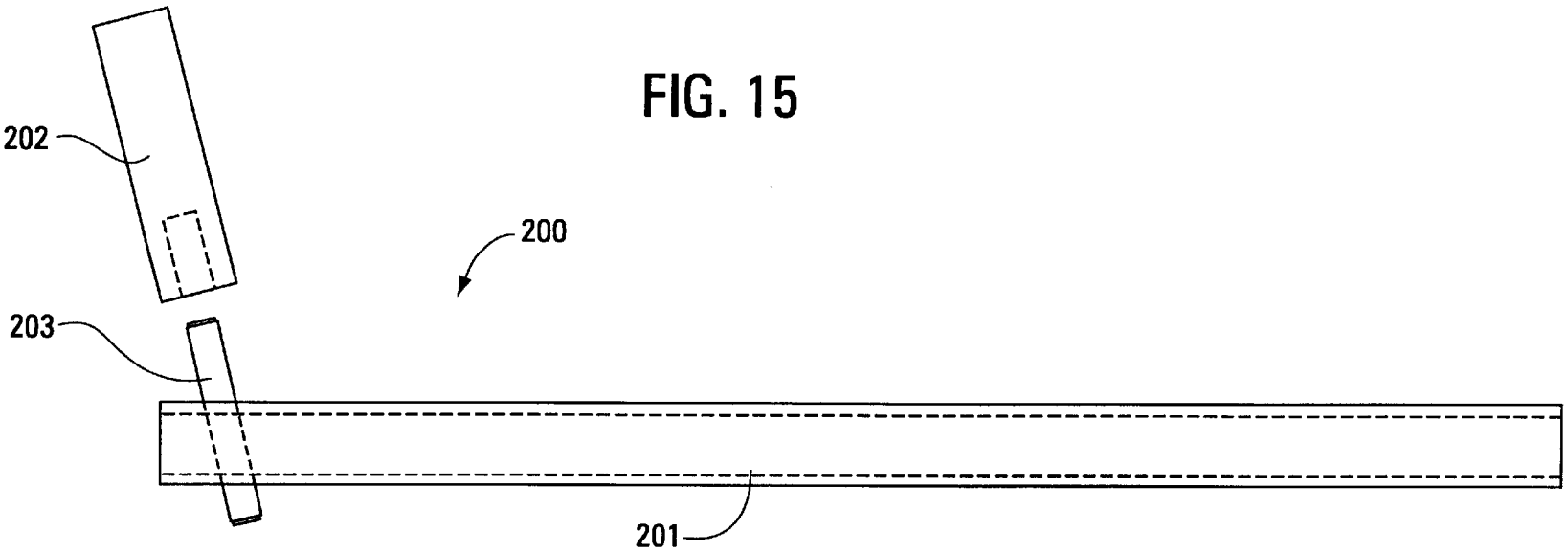
FIG. 15 is a side view of one embodiment of a tool for engaging the pivot shaft and pivoting the mounting assembly and support assembly between the clearance position and the support position.

FIG. 15 shows an embodiment of the tool 120 comprising a handle 201 with a suitably sized and shaped socket 202 removably attached to one end of the handle 201 by a dowel 203. The other end of the handle 201 can be knurled (not shown) or coated with a soft material, such as a natural or synthetic rubber or polyurethane, to enhance gripability of the tool 200.

As shown in FIG. 18, a pair of longitudinally aligned openings 119 may be provided through the first 112 and second 113 legs of the base 110, with the openings configured and arranged so as to accommodate passage of the handle 201 through the openings 119 after the support assembly 120 or engagement means 220 has been pivoted into the support position, and locking the proximal end 132*p* of a pair of brackets 132 attached to one of the pivot shafts 131 between the handle 201 and the associated central beam 111.

Use

As shown best in FIGS. 1, 2 and 3, the first embodiment of the stand 100 is used by (i) placing the support assembly 120 into the clearance position, (ii) sliding the stand 100 underneath the frame F of the motorcycle M at the desired location, (iii) attaching the socket 202 to the handle 201, (iv) engaging the first end 131*a* of the extended pivot shaft 131 with the socket 202, (v) stepping onto the foot flange 113 to stabilize the stand 100, and (vi) rotating the pivot shaft 131 so as to effect pivoting of both support assemblies 120 from the clearance position, generally horizontal to the ground, to the support position, generally vertical to the ground and slightly past the center of gravity. Once the support assemblies 120 begin to pivot beyond the center of gravity, the weight of the motorcycle M upon the support assembly 120 causes the support assemblies 120 to drop and lock in the support position, with the fingers 133 of the brackets 132 bearing upon the corresponding central beam 111 of the base assembly 110. The socket 202 can then be detached from the extended pivot shaft 131 and stored until the stand 100 needs to be removed.

Use of the second embodiment of the stand 100 is identical to use of the first embodiment except that the first time the second embodiment is used with a given motorcycle M, each of the brackets 132 and the corresponding engagement element 220 must be longitudinally aligned with an appropriate section of the motorcycle frame F before the pivot shaft 131 is rotated into the support position.

Both the first and second embodiments of the stand 100 can be quickly and easily removed from underneath the motorcycle M by simply (i) attaching the socket 202 to the handle 201, (ii) engaging the first end 131*a* of the extended pivot shaft 131 with the socket 202, (v) stepping onto the foot flange 113 to stabilize the stand 100, and (iii) rotating the pivot shaft 131 so as to effect pivoting of the support assemblies 120 from the support position to the clearance position. Once the support assemblies 120 begin to pivot beyond the center of gravity, the weight of the motorcycle M upon the support assemblies 120 will force the support assemblies 120 to move towards the clearance position until the elevated motorcycle M contacts the ground. Gravity will cause the support assemblies 120 and the corresponding brackets 132 to continue pivoting toward the clearance position until the front edge (unnumbered) of the brackets 132 bear against the top (unnumbered) of the corresponding central beam 111 of the base assembly 110. Once the support assembly 120 is in the clearance position, the socket 202 can be detached from the extended pivot shaft 131 and the stand 100 slid from underneath the motorcycle M. The stand 100 and tool 200 can then be stored together until needed.

When in the support position, the support assembly 120 engages the frame F of the motorcycle M and lifts or elevates at least one end of the motorcycle M off the ground.

Several models of the stand 100 can be constructed to provide different heights to which the stand 100 lifts the motorcycle M by varying the size of the base assembly 110. Alternatively, each stand 100 can be provided with a means for adjusting the height to which the stand 100 can lift the motorcycle M, such as by employing a plurality of transversely spaced holes 134 through the brackets 132 as shown in FIGS. 3 and 4, or employing a plurality of transversely spaced holes 227 through the legs 223 of the engagement means 220 as shown in FIG. 18. By way of example, when the first of such height adjustment means is employed, the height of a support assembly 120 may be quickly adjusted by (i) removing the retaining rings (not shown) from the circumferential groove 121*g* in the first end 121*a* of each axle 121, (ii) sliding each axle 121 completely through both connect arms 126 and both brackets 132, (iii) reinserting each axle 121 through both connect arms 126 and both brackets 132 using a different set of longitudinally aligned holes 134 through the brackets 132, and (iv) replacing the retaining rings on each axle 121. The procedure can also be done from the other longitudinal end of the stand 100 by removing the retaining rings (not shown) from the circumferential groove 121*g* in the second end 121*b* of each axle 121.

While preferred embodiments of the invention have been described, it should be understood that various changes, adaptations and modifications may be made to the invention without departing from the spirit of the invention and the scope of the appended claims.

What is claimed is:

1. A hand-operable stand, comprising:

(a) a base having a first longitudinal end and a second longitudinal end, (b) a first longitudinally extending pivot shaft rotatably attached to the base for pivoting between a clearance position and a support position, (c) a second longitudinally extending pivot shaft transversely spaced from the first pivot shaft and rotatably attached to the base for pivoting between the clearance position and the support position, (d) a pair of longitudinally spaced brackets fixedly attached at a first end to the first pivot shaft so as to be effective for translating rotation of the first pivot shaft to pivoting of the first bracket pair, (e) a second pair of longitudinally spaced brackets fixedly attached at a first end to the second pivot shaft so as to be effective for translating rotation of the second pivot shaft to pivoting of the second bracket pair, (f) a first transversely extending engagement means pivotably attached proximate the distal end of a right bracket from the first bracket pair and a right bracket from the second bracket pair, (g) a second transversely extending engagement means pivotably attached proximate the distal end of a left bracket from the first bracket pair and a left bracket from the second bracket pair, (h) a means for preventing continued pivoting of the first and second engagement means beyond the support position, and (i) a flange longitudinally extending from the first longitudinal end of the base, configured and arranged to be engaged by a user's foot for purposes of stabilizing the stand during pivoting of the first and second engagement means between the clearance and support positions.

2. A hand-operable stand, comprising:

(a) a base having a first longitudinal end and a second longitudinal end, (b) a first longitudinally extending pivot shaft rotatably attached to the base for pivoting between a clearance position and a support position, (c) a second longitudinally extending pivot shaft transversely spaced from the first pivot shaft and rotatably attached to the base for pivoting between the clearance position and the support position, (d) a pair of longitudinally spaced brackets fixedly attached at a first end to the first pivot shaft so as to be effective for translating rotation of the first pivot shaft to pivoting of the first bracket pair, (e) a second pair of longitudinally spaced brackets fixedly attached at a first end to the second pivot shaft so as to be effective for translating rotation of the second pivot shaft to pivoting of the second bracket pair, (f) a first transversely extending engagement means pivotably attached proximate the distal end of a right bracket from the first bracket pair and a right bracket from the second bracket pair, (g) a second transversely extending engagement means pivotably attached proximate the distal end of a left bracket from the first bracket pair and a left bracket from the second bracket pair, (h) a means for preventing continued pivoting of the first and second engagement means beyond the support position, (i) wherein the pivot shafts have a hexagonal cross section.

3. A hand-operable stand, comprising:

(a) a base having a first longitudinal end and a second longitudinal end, the base including (i) a pair of transversely spaced longitudinally extending beams, (ii) a first leg secured to the beams proximate a first longitudinal end of each beam, and (iii) a second leg secured to the beams proximate a second longitudinal end of each beam, (b) a first longitudinally extending pivot shaft rotatably attached to the base for pivoting between a clearance position and a support position, (c) a second longtudinally extending pivot shaft transversely spaced from the first pivot shaft and rotatable attached to the base for pivoting between the clearance position and the support position, (d) a first pair of longitudinally spaced brackets fixedly attached at a first end to the first pivot shaft so as to be effective for translating rotation of the first pivot shaft to pivoting of the first bracket pair, (e) a second pair of longitudinally spaced brackets fixedly attached at a first end to the second pivot shaft so as to be effective for translating rotation of the second pivot shaft to pivoting of the second bracket pair, (f) a first transversely extending engagement means pivotably attached proximate the distal end of a right bracket from the first bracket pair and a right bracket from the second bracket pair, (g) a second transversely extending engagement means pivotably attached proximate the distal end of a left bracket from the first bracket pair and a left bracket from the second bracket pair, (h) wherein continued pivoting of the engagement means beyond the support position is prevented by configuring and arranging a combination of at least one of the brackets and an associated beam such that the first end of the configured and arranged bracket bears against the associated beam when the engagement means reaches the support position.

4. The stand of claim 3 wherein each of the first and second bracket pairs is associated with one of the beams and both the right and left brackets in both bracket pairs are configured and arranged so that the first end of the bracket bears against the associated beam when the engagement means reaches the support position.

5. The stand of claim 1 wherein the engagement means are pivoted beyond the center of gravity when pivoted from the clearance position to the support position.

6. The stand of claim 3 wherein the engagement means pivots about 2° to 10° beyond the center of gravity when pivoted from the clearance position to the support position.

7. The stand of claim 1 further comprising means for adjusting the transverse position of the engagement means relative to the base so as to increase or decrease the distance between the engagement means and the base.

8. The stand of claim 1 further comprising means for releasably locking the brackets in the support position.

9. The stand of claim 8 whereby the locking means traps the first end of the configured and arranged bracket between a structural element and the central beam.

10. The stand of claim 3 further comprising means for adjusting the transverse position of the engagement means to the base so as to increase or decrease the distance between the engagement means and the base.

11. The stand of claim 3 further comprising means for releasably locking the brackets in the support position.

12. The stand of claim 11 wherein the locking means traps the first end of the configured and arranged bracket between a structural element and the central beam.

13. The stand of claim 1 wherein the first transversely extending engagement means further comprises an open-faced channel and the second transversely extending engagement means further comprises an open-faced channel.

* * * * *